United States Patent [19]

Reimann

[11] Patent Number: 4,688,399

[45] Date of Patent: Aug. 25, 1987

[54] HEAT PIPE ARRAY HEAT EXCHANGER

[75] Inventor: Robert C. Reimann, Lafayette, N.Y.

[73] Assignee: Carrier Corporation, Syracuse, N.Y.

[21] Appl. No.: 883,860

[22] Filed: Jul. 11, 1986

Related U.S. Application Data

[63] Continuation of Ser. No. 668,457, Nov. 5, 1984, abandoned.

[51] Int. Cl.[4] ..... F25B 15/02

[52] U.S. Cl. ..... 62/485; 62/513; 165/104.14

[58] Field of Search ..... 165/104.14, 104.21; 62/513, 333, 485

[56] References Cited

U.S. PATENT DOCUMENTS

| | | | |
|---|---|---|---|
| 2,499,736 | 3/1950 | Kleen | 165/104.14 |
| 4,285,027 | 8/1981 | Mori et al. | 165/104.14 |
| 4,448,239 | 5/1984 | Edwards | 165/104.14 |

FOREIGN PATENT DOCUMENTS

| | | | |
|---|---|---|---|
| 2340525 | 9/1977 | France | 165/104.14 |
| 31290 | 2/1983 | Japan | 165/104.14 |

*Primary Examiner*—Albert W. Davis, Jr.
*Attorney, Agent, or Firm*—Robert H. Kelly

[57] ABSTRACT

A heat pipe arrangement for exchanging heat between two different temperature fluids. The heat pipe arrangement is in a ounterflow relationship to increase the efficiency of the coupling of the heat from a heat source to a heat sink.

5 Claims, 4 Drawing Figures

HEAT PIPE ARRAY HEAT EXCHANGER

This application is a continuation of application Ser. No. 668,457 filed Nov. 5, 1984 now abandoned.

BACKGROUND OF THE INVENTION

This invention relates to heat exchangers and, more particularly, to a plurality of heat pipes which provide an effective coupling of heat from a source to a heat sink.

A heat pipe is a simple, mechanically static, closed or sealed chamber containing a working fluid having both a liquid phase and a vapor phase within the desired range of operating temperatures. In such a heat pipe, air or other non-condensable gases are usually evacuated from the sealed chamber. The chamber then contains only the liquid and vapor of the working fluid at a pressure corresponding to the saturation pressure of the working fluid at the temperature of the heat pipe. When one portion of the chamber containing liquid is exposed to a relatively high temperature it functions as an evaporator section. The resulting heat flow will cause evaporation to take place resulting in an increase in the vapor pressure of the working fluid. A vapor that is formed, being at a higher pressure, will flow towards the colder regions of the chamber, defined as a condenser section, and will condense on the relatively cooler surfaces inside the chamber wall. Capillary action and/or gravitational flow will return the liquid condensate to the evaporator section. Because the heat of evaporation is absorbed by the phase change from liquid to vapor and released when condensation of the vapor takes place, large amounts of heat can be transported with very small temperature gradients from areas of heat addition to areas of heat removal.

Heat pipes are generally made as individual tubes and clustered together where additional capacity is required. These heat pipes are used in connection with heating and cooling of various devices or structures. For example, U.S. Pat. Nos. 3,865,184 and 4,440,215 illustrate the use of heat pipes in a regenerator to exchange heat between intake air as it flows into an enclosure and exhaust air as it flows out of the enclosure. Generally, these heat pipes are arranged in a shell in a horizontal array with wick members to aid in the liquid transport from condenser to evaporator. However, the heat pipes may be constructed without wicking members if the condensate section is slightly elevated above the evaporator section. In the prior art source and sink fluids typically flow transverse to the longitudinal axis of the heat pipes but in the same direction. Other prior art devices had the evaporator heat pipes connected to a common manifold and the condenser heat pipes connected to another common manifold, whereby the two manifolds were in fluid communication. Accordingly, these heat pipes were at the same pressure and connected in a parallel flow arrangement. This parallel flow is a major factor in the low efficiency of such previously devised heat pipe heat exchangers. This lower efficiency is caused by a non-uniform temperature difference between the two fluids which results from a parallel flow arrangement. A counter flow arrangement, however, would take advantage of the most uniform temperature difference between the sink and source fluid streams thus utilizing the heat transfer surfaces most effectively.

Thus it would be desirable to provide a heat exchanger which overcomes the problems of the previously devised heat pipe heat exchangers relating to less than maximum heat transfer efficiency.

SUMMARY OF THE INVENTION

The present invention is directed to an improved heat pipe heat exchanger array which increases the efficiency of the heat exchanger by providing a counter flow arrangement.

In a preferred embodiment, a first condenser shell is provided having an inlet and outlet through which the cooling medium flows, and a vaporizing shell also having an inlet and outlet through which the heating medium flows, and an array of heat pipes having a condenser section above a vaporizing section. The hot vaporizing fluid flows first across the nearest tube in the vaporizing section of the heat pipe array and then flows across the remaining pipes to the farthest heat pipe and then is discharged through the outlet. In the condensing section, a cooling medium enters the inlet and flows first across the nearest heat pipe tube, which communicates with the heat pipe tube of the vaporizer nearest the outlet, and then across the remaining heat pipes and is discharged through the condenser outlet. Accordingly, a counterflow arrangement is created because each heat pipe can be a different pressure and the heat pipe section nearest the hot fluid flowing through the vaporizer inlet communicates with the heat pipe nearest the hot fluid flowing through the condenser section outlet, while the vaporizer heat pipe section nearest the cooler medium flowing through the outlet communicates with the heat pipe section nearest the cooler fluid flowing through the condenser section inlet. This counterflow arrangement causes the most uniform mean temperature difference for vaporizer medium and condenser medium temperatures thus making efficient use of all heat transfer surfaces equally.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
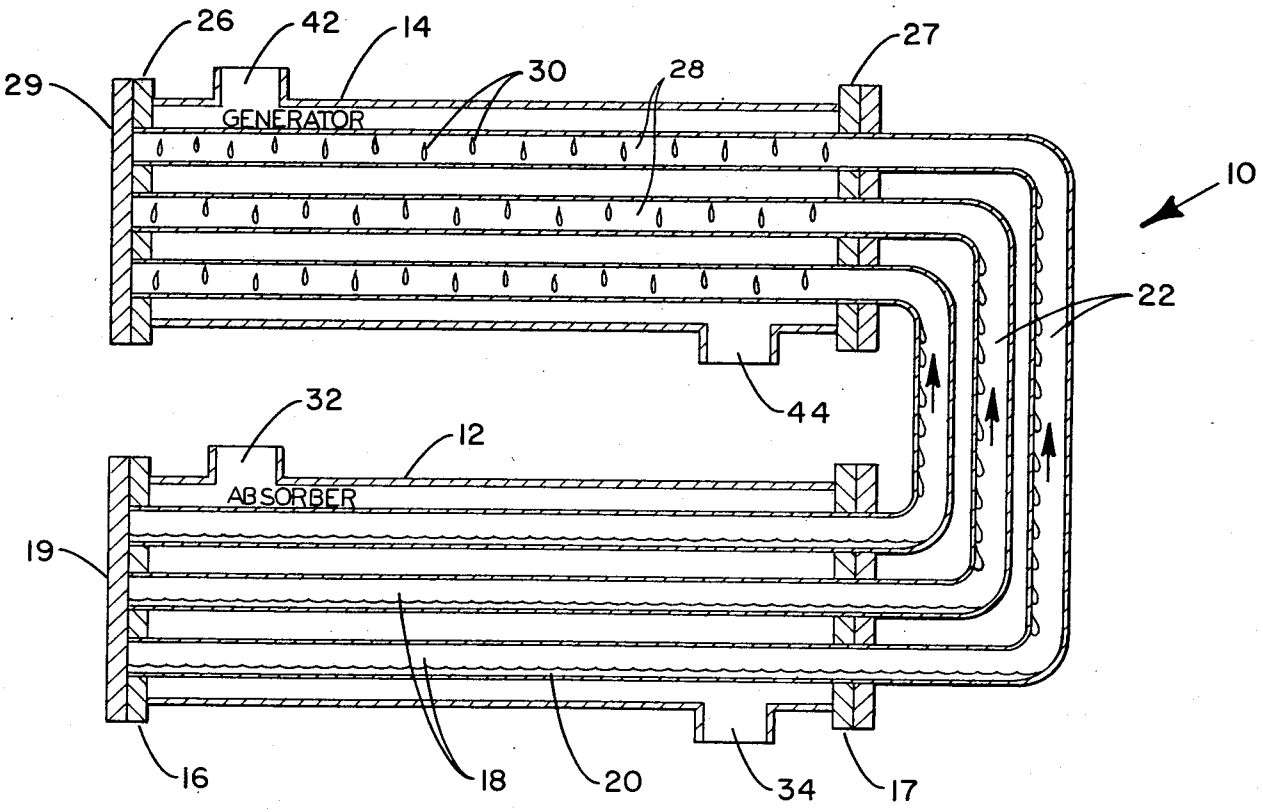
FIG. 1 is a diagrammatic view, in vertical section, of the side elevation of a heat pipe array made in accordance with the present invention.

Referring now to FIG. 1 there is shown a generally C-shaped heat pipe array for exchanging heat between a lower shell or heat source 12 and an upper shell or heat sink 14. The lower shell is comprised of tube sheets 16 and 17 which support the bottom leg section 18 of the C-shaped heat pipe, and an end cap 19 which hermetically seals the bottom leg section 18 of each heat pipe. The upper shell 14 is comprised of tube sheets 26 and 27 which support the upper leg section 28 of each heat pipe, and an end cap 29 which hermetically seals the upper leg sections of each heat pipe. A connecting section 22 is provided so that the bottom leg section 18 and the upper leg section 28 of each heat pipe may be joined to form a tube hermetically sealed at both ends. It is noted that the generally C-shaped heat pipes may be formed by connecting individual sections together or by bending a single length straight tube.

The lower shell 12 contains an inlet 32 and outlet 34 therethrough, which a heating medium flows in heat exchange relationship with the bottom leg sections 18 of the heat pipe. Accordingly, the fluid entering the inlet 32 is at a higher temperature than the fluid leaving outlet 34. Correspondingly, the upper shell 14 has inlet 42 and an outlet 44, through which a cooling medium flows. Thus, the fluid entering the inlet 42 is cooler than the fluid exiting through outlet 44.

Basically, each generally C-shaped heat pipe of an array comprises a sealed tube charged with a vaporizable liquid of four regions, (a) the evaporator in which the working fluid 20 is vaporized by the input heat flowing through the lower shell 12, (b) the vapor transport connecting section 22 through which vapor flows from the evaporator to the upper leg section 28 of the condenser, (c) the condenser or upper leg section 28 where the vapor gives up heat and is condensed to liquid 30 (as illustrated by the droplets), and (d) the liquid transport or connecting section 22 in which the liquid condensate flows back to the bottom leg section 18 or evaporator.

In many absorption refrigeration/heat pump systems component to component high efficiency heat exchangers are necessary for the operation of the system. It is also important that a minimum approach temperature difference be maintained between fluids, thus necessitating counterflow heat exchange. Thermally coupling separate tube bundles in different components by typical heat exchanger configurations becomes difficult by conventional secondary fluid circulation means, which require a pump as well as yielding poor approach temperatures and high parasitic power.

The present invention solves this problem, when for example, the lower shell 12 is a heat source or an absorber and the upper shell 14 is a heat sink or generator of an absorption system, by having a row by row coupling of tubes in a heat pipe configuration yielding a counterflow heat exchange arrangement resulting in efficient surface use and low approach temperature. In the absorber the working fluid 20 in the heat pipe is vaporizable in the evaporator or bottom leg section 18 of the heat pipe with the resulting vapors flowing upwardly (as indicated by the arrows) through the connecting section 22 to the upper leg section 28, located in the absorption system generator, where the vapor is condensed on the inner walls of the upper leg section 28 and then, returns down through the connecting section 22 to the lower leg section 18 to repeat the cycle.

It is to be understood that any suitable type working fluid may be employed in connection with the heat pipes, for example, one of the freons, methanol, or even water may be employed.

Figure 2:
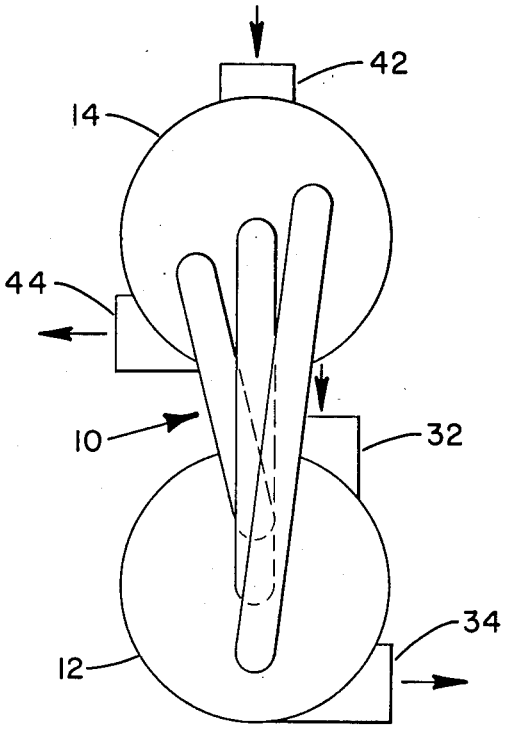
FIG. 2 is a diagrammatic view of the front elevation of one embodiment of the present invention.
Figure 3:
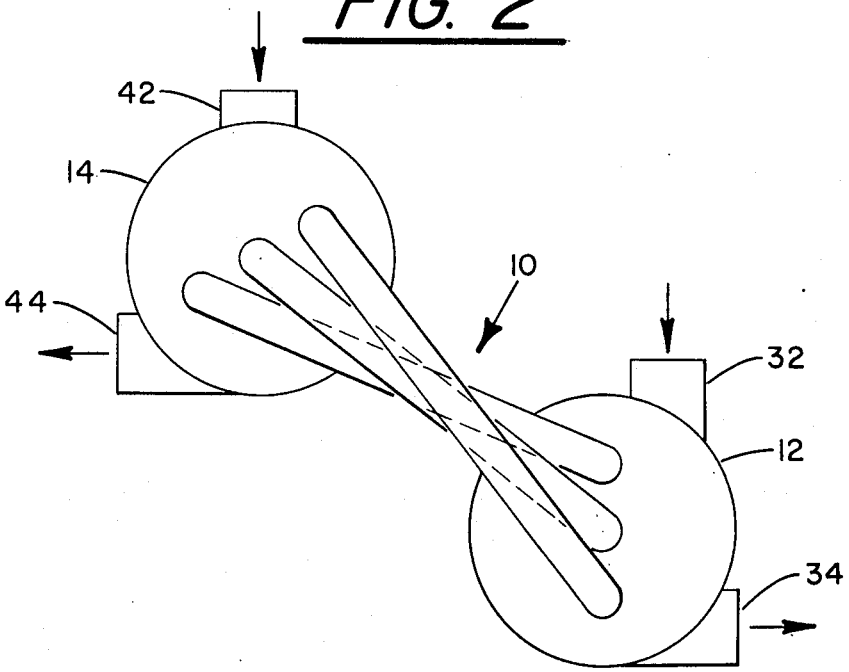
FIG. 3 is a diagrammatic view of a front elevation of another embodiment of the present invention.
Figure 4:
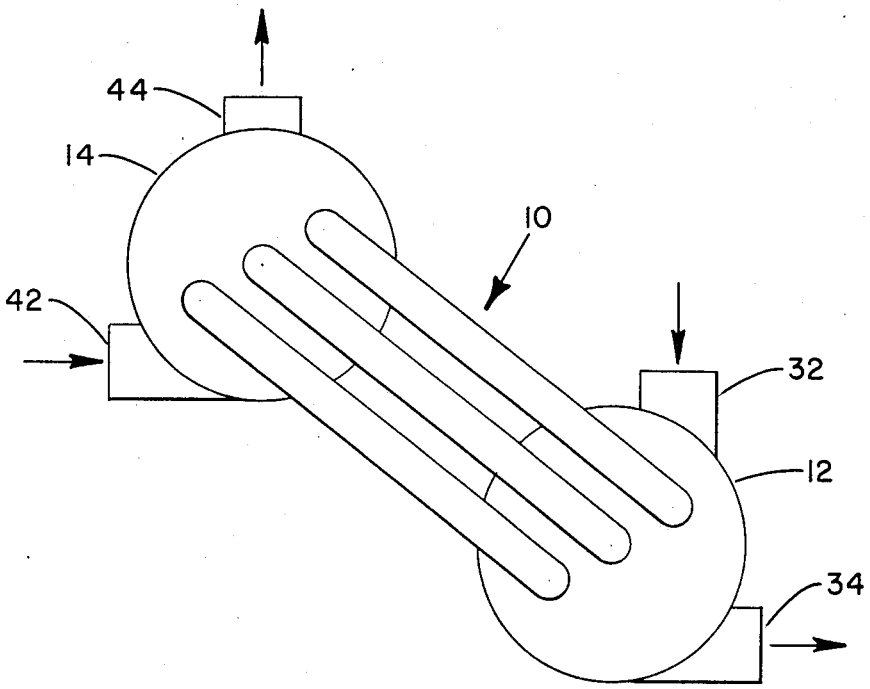
FIG. 4 is a diagrammatic view of the front elevation of yet another embodiment of the present invention.

While the various heat pipes of the heat exchanger illustrated in FIG. 1 are disposed generally in a horizontal plane and in vertical alignment one above the other, it is to be understood that the corresponding upper and lower legs need not be one above the other for proper operation. FIGS. 2, 3 and 4 illustrate exemplary orientation of different heat pipe arrays. It is to be understood, however, that the position of the horizontal legs in the heat source vessel 12 with respect to the position of each corresponding leg in the heat sink vessel 14 are in direct inverse relationship with the heating and cooling fluids entering and leaving the respective vessels. Thus the lower leg of the heat pipe closest to the inlet 32 of the hot entering fluid of the heat source is connected to the upper leg of the heat pipe closest to the outlet 44 of the hot exiting fluid of the heat sink, while the lower leg of the heat pipe closest to the outlet 34 of the cooler leaving fluid of the heat source is connected to the upper leg of the heat pipe closest to the inlet 42 of the cooler entering fluid of the heat sink. Accordingly, this arrangement of the legs of the heat pipe array in relationship with the heating and cooling fluids flowing through the vessels insures counterflow heat exchange.

What is claimed is:

1. A heat exchanger for transferring heat between a first fluid and a second fluid in an absorption refrigeration system comprising:

a first shell having an inlet for receiving the first fluid at a first elevated temperature and an outlet for discharging the first fluid at a first reduced temperature with the shell defining a free flow path for the first fluid flowing there through;

a second shell located at a higher elevation than the first shell and having an inlet for receiving the second fluid at a second reduced temperature near an upper portion of said second shell and an outlet for discharging the second fluid at a second elevated temperature generally near a lower portion of said second shell with said second shell defining a free flow path for the second fluid flowing there through, said free flow path for the second fluid being free from internal restrictions which would cause thermal stratification of the second fluid wherein the second fluid flowing through said second shell flows serially through said second shell inlet, said free flow path in said second shell, and said second shell outlet;

a plurality of heat pipes, each having a generally horizontal first member disposed within said first shell, a generally horizontal second member disposed within said second shell and a connecting member disposed there between with each of said first members disposed at a lower elevation than its connected second members;

said first members of said plurality of heat pipes being serially located in said free path between said inlet and outlet of said first shell, with the corresponding second members of said plurality of heat pipes being serially located in said free path between said inlet and said outlet of said second shell in reverse order from that in said first shell whereby said first member located nearest said inlet of said first shell contacts said first fluid at said first elevated temperature and connects with the corresponding said second member nearest said outlet of said second shell which contacts said second fluid at said second elevated temperature, while each serially located first member contacts said first fluid at a successively reduced first elevated temperature and connects with each corresponding serially located said second member which contacts said second fluid at a successively reduced second level elevated temperature; and a medium contained within each said heat pipe wherein said medium transports and transfers heat between said first and second fluids to maintain a minimum approach temperature difference between the first fluid and the second fluid in an absorption refrigeration system.

2. A heat exchanger as recited in claim 1 wherein the first shell is an absorption absorber and the second shell is an absorption generator.

3. A heat exchanger as recited in claim 2 wherein the second fluid flowing through said absorption generator is a heat sink and the first fluid flowing through said absorption absorber is a heat source.

4. A heat exchanger as recited in claim 3 wherein said medium is generally vaporizable within said first members within said absorber and generally condensable within said second members within said generator.

5. A heat exchanger as recited in claim 4 wherein said heat pipes are generally C-shaped.

* * * * *